US009833030B1

(12) United States Patent
Chang

(10) Patent No.: US 9,833,030 B1
(45) Date of Patent: Dec. 5, 2017

(54) FABRIC FOLDING MACHINE

(71) Applicant: Donwei Machinery Ind. Co., Ltd., Taichung (TW)

(72) Inventor: Pi-chao Chang, Taichung (TW)

(73) Assignee: Donwei Machinery Ind. Co., Ltd., Taichuang (TW)

( * ) Notice: Subject to any disclaimer, the term of this patent is extended or adjusted under 35 U.S.C. 154(b) by 43 days.

(21) Appl. No.: 15/171,674

(22) Filed: Jun. 2, 2016

(51) Int. Cl.
*A41H 43/02* (2006.01)
*B65H 45/09* (2006.01)
*B65H 45/22* (2006.01)

(52) U.S. Cl.
CPC ..... *A41H 43/0257* (2013.01); *A41H 43/02* (2013.01); *B65H 45/09* (2013.01); *B65H 45/22* (2013.01)

(58) Field of Classification Search
CPC .. A41H 43/02; A41H 43/0221; A41H 43/025; A41H 43/0257; A41H 43/0264; A41H 33/00; B65H 45/00–45/09; B65H 45/22; B65H 2301/45; B65H 2301/451; B65H 2701/174; D06F 89/00; D06F 89/005; D05B 35/00; D05B 35/02; D05B 35/062; D05B 35/08
See application file for complete search history.

(56) References Cited

U.S. PATENT DOCUMENTS 351,452 A * 10/1886 Marsh et al. ..... B65H 45/107 125/30.01
2,149,755 A * 3/1939 Ackerman ..... D05B 35/062 112/147
2,929,303 A * 3/1960 Armstrong ..... B65H 45/30 493/404
3,534,953 A * 10/1970 Appleby ..... B29C 53/043 156/443
4,089,514 A * 5/1978 Skipworth ..... B65H 45/22 270/5.01
4,298,148 A * 11/1981 Gakiya ..... A41H 31/00 223/37
5,189,769 A * 3/1993 Shoesmith ..... B65H 45/09 112/147
5,445,591 A * 8/1995 Fougere ..... B65H 45/09 493/439
5,554,095 A * 9/1996 Matsuo ..... B65H 45/22 493/440
6,641,516 B2 * 11/2003 Ozeki ..... B65H 37/04 223/37

* cited by examiner

*Primary Examiner* — Ismael Izaguirre

(57) ABSTRACT

A fabric folding machine contains: a body and a limiter. The body includes an external housing, an internal housing, and a connection portion. The external housing has a first peripheral fence, a second peripheral fence, and two third peripheral fences, wherein the internal housing is disposed in the external housing, and between the external housing and the internal housing is defined a through hole which has a first segment and a second segment, a height of the first segment is more than that of the second segment, and a width of the internal housing gradually decreases from the first segment to the second segment. The first peripheral fence has a first orifice defined, and the second peripheral fence has a second orifice and two guiding apertures. The limiter includes a sheet and a protrusion, and the sheet has two openings defined thereon.

8 Claims, 11 Drawing Sheets

FABRIC FOLDING MACHINE

FIELD OF THE INVENTION

The present invention relates to a fabric folding machine which folds a fabric strip in half repeatedly.

BACKGROUND OF THE INVENTION

Conventional fabric folding machine are disclosed in U.S. Pat. Nos. 5,554,095 and 6,641,516 so as to fold a fabric strip in half solely.

However, two peripheral sides of the fabric strip are folded inwardly in half by the fabric folding machine and then are manually folded in half once more.

The present invention has arisen to mitigate and/or obviate the afore-described disadvantages.

SUMMARY OF THE INVENTION

The primary objective of the present invention is to provide a fabric folding machine which folds a fabric strip in half repeatedly.

To obtain above-mentioned objective, a fabric folding machine provided by the present invention contains: a body and a limiter.

The body is integrally formed and includes an external housing, an internal housing, and a connection portion. The external housing has a first peripheral fence, a second peripheral fence opposite to the first peripheral fence, and two third peripheral fences connected with the first peripheral fence and the second peripheral fence, wherein the internal housing is disposed in the external housing, and between the external housing and the internal housing is defined a through hole. The through hole has a first segment and a second segment, and a height of the first segment is more than that of the second segment. The connection portion is in connection with the first peripheral fence of the external housing and the internal housing and its width gradually decreases from the first segment to the second segment, wherein the first peripheral fence has a first orifice defined thereon, the second peripheral fence has a second orifice communicating with the through hole, and the second peripheral fence also has two guiding apertures communicating with the through hole.

The limiter includes a sheet and a protrusion extending outwardly from the sheet so as to alternatively accommodate in the first orifice or the second orifice of the body, wherein the sheet has two openings defined thereon.

DETAILED DESCRIPTION OF THE PREFERRED EMBODIMENTS

Figure 1:
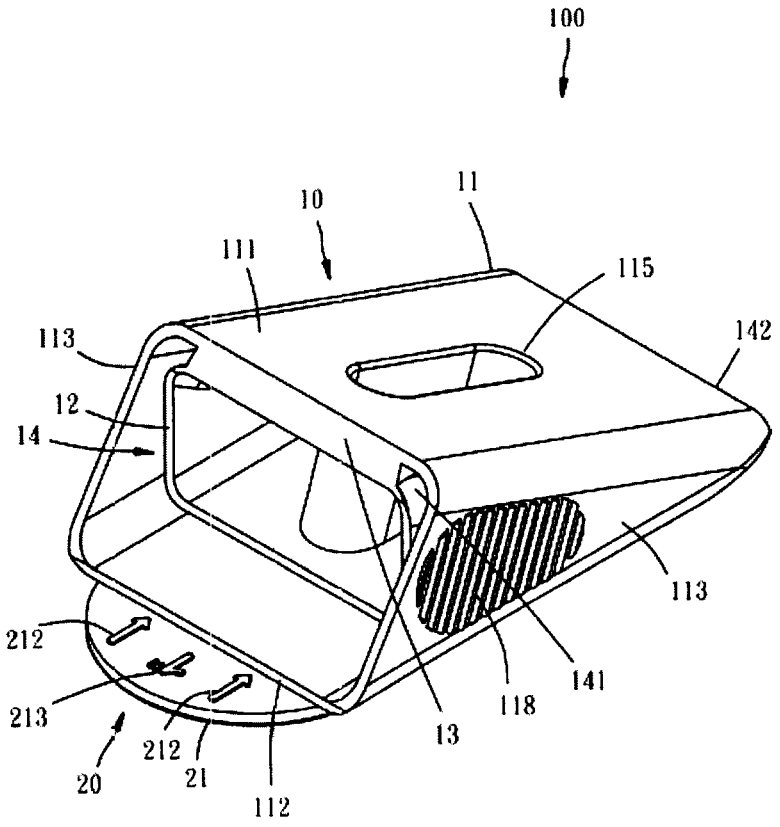
FIG. 1 is a perspective view showing the assembly of a fabric folding machine according to a preferred embodiment of the present invention.

With reference to FIGS. 1 to 10, a fabric folding machine 100 according to a preferred embodiment of the present invention comprises: a body 10 and a limiter 20.

Referring to FIGS. 1 to 6, the body 10 is integrally formed and includes an external housing 11, an internal housing 12, and a connection portion 13. The external housing 11 has a first peripheral fence 111, a second peripheral fence 112 opposite to the first peripheral fence 111, and two third peripheral fences 113 connected with the first peripheral fence 111 and the second peripheral fence 112, wherein the internal housing 12 is disposed in the external housing 11 and is spaced from the external housing 11 by a gap defined by a through hole 14, i.e., the through hole 14 is located between the external housing 11 and the internal housing 12. The through hole 14 has a first segment 141 and a second segment 142, and a height of the first segment 141 is more than that of the second segment 142. The connection portion 13 is in connection with the first peripheral fence 111 of the external housing 11 and the internal housing 12 and its width gradually decreases from the first segment 141 to the second segment 142, wherein the first peripheral fence 111 has a first orifice 115 defined thereon, the second peripheral fence 112 has a second orifice 116 communicating with the through hole 14, and the second peripheral fence 112 also has two guiding apertures 117 communicating with the through hole 14. The third peripheral fence 113 has an anti-slip portion 118 arranged on an outer surface thereof, and the anti-slip portion 118 is a rough face.

Figure 2:
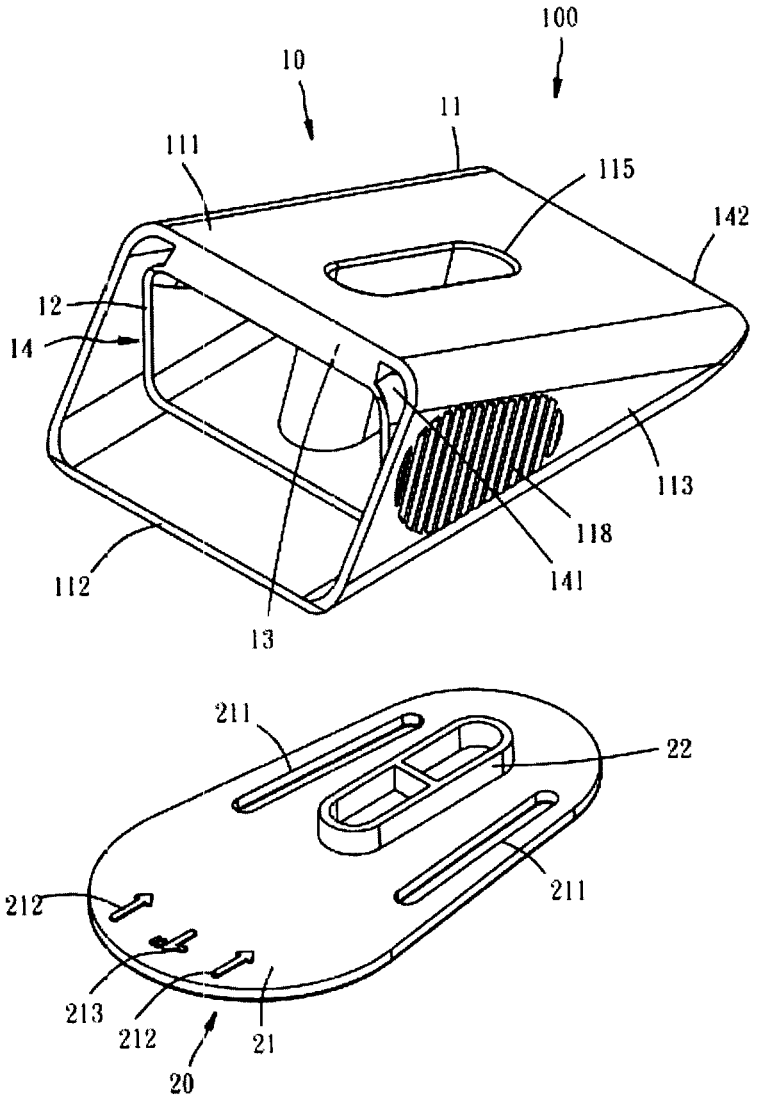
FIG. 2 is a perspective view showing the exploded components of the fabric folding machine according to the preferred embodiment of the present invention.
Figure 3:
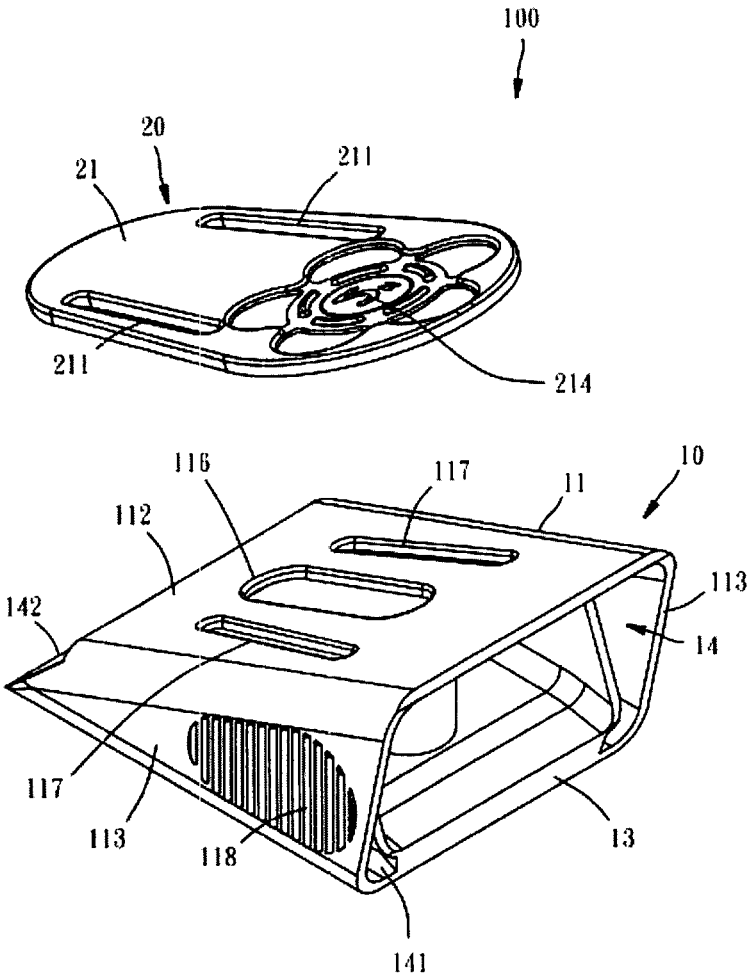
FIG. 3 is another perspective view showing the exploded components of the fabric folding machine according to the preferred embodiment of the present invention.
Figure 4:
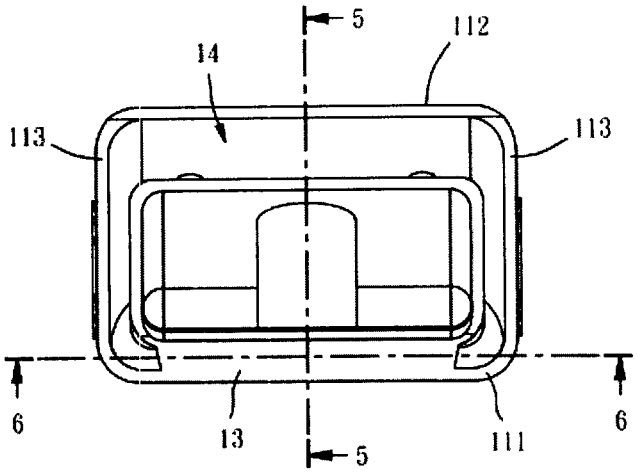
FIG. 4 is a cross sectional view showing the assembly of the fabric folding machine according to the preferred embodiment of the present invention.
Figure 5:
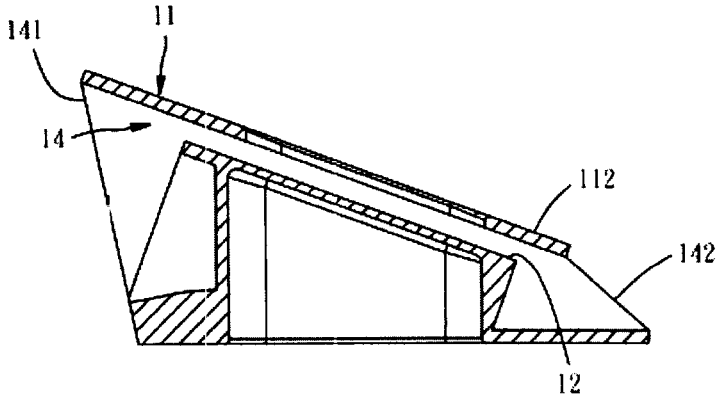
FIG. 5 is a cross sectional view taken along the line 5-5 of FIG. 4.
Figure 6:
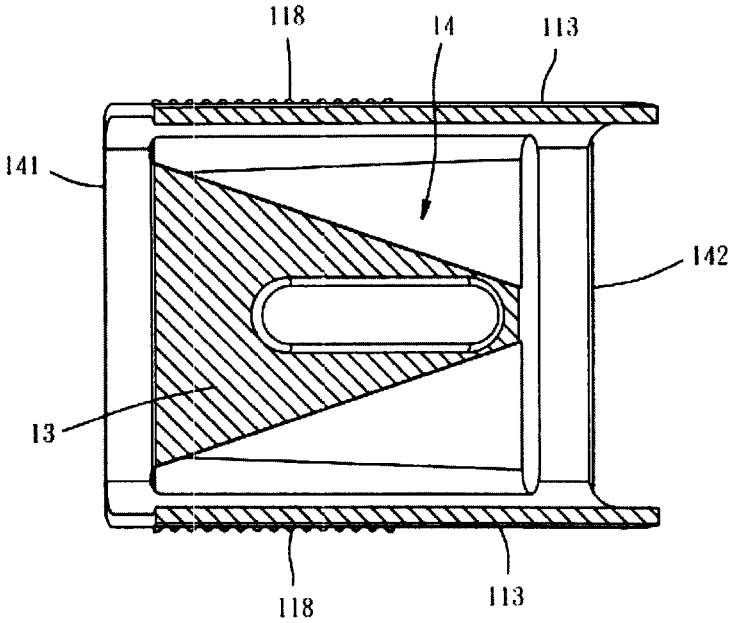
FIG. 6 is a cross sectional view taken along the line 6-6 of FIG. 4.

As shown in FIGS. 1 to 3, the limiter 20 includes a sheet 21 and a protrusion 22 extending outwardly from the sheet 21 so as to alternatively accommodate in the first orifice 115 or the second orifice 116 of the body 10, wherein the sheet 21 has two openings 211 defined thereon.

Figure 7:
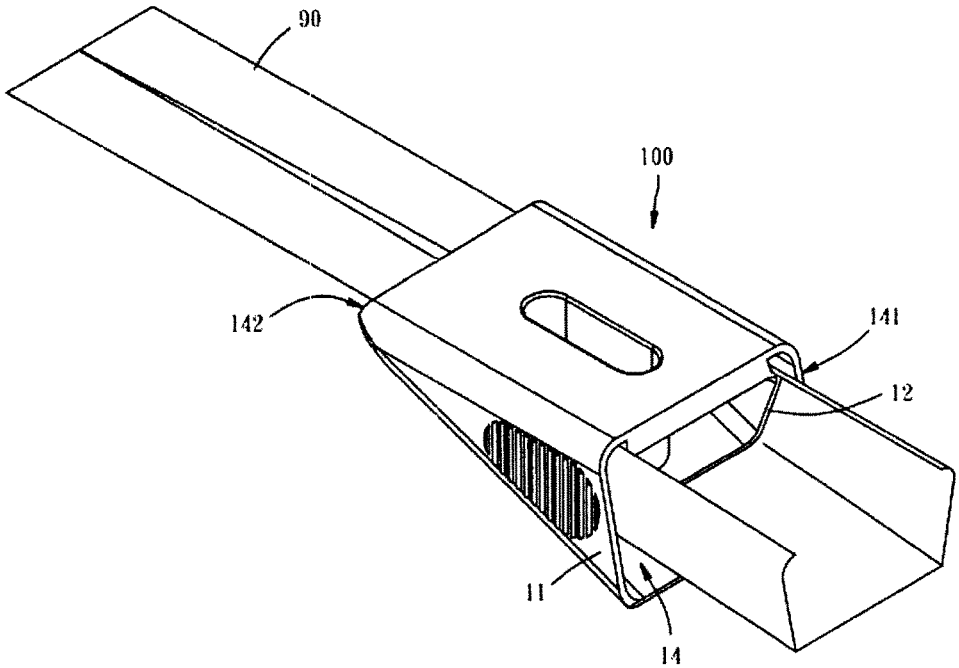
FIG. 7 is a perspective view showing the operation of the fabric folding machine according to the preferred embodiment of the present invention.
Figure 8:
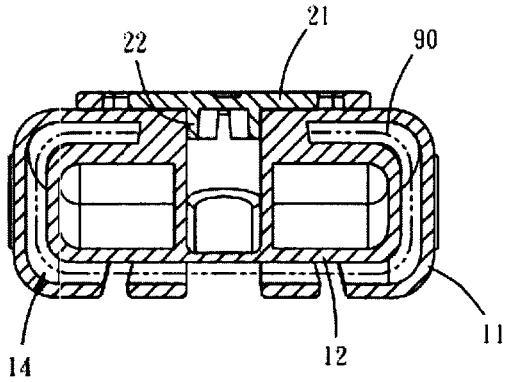
FIG. 8 is a cross sectional view showing the operation of the fabric folding machine according to the preferred embodiment of the present invention.

In operation, a fabric strip 90 is folded in half and is inserted toward the second segment 142 of the through hole 14 from the first segment 141 of the through hole 14, as illustrated in FIGS. 7 and 8, hence after the fabric strip 90 extends out of the second segment 142, its two peripheral sides are folded inwardly, as shown in FIG. 7.

Figure 9:
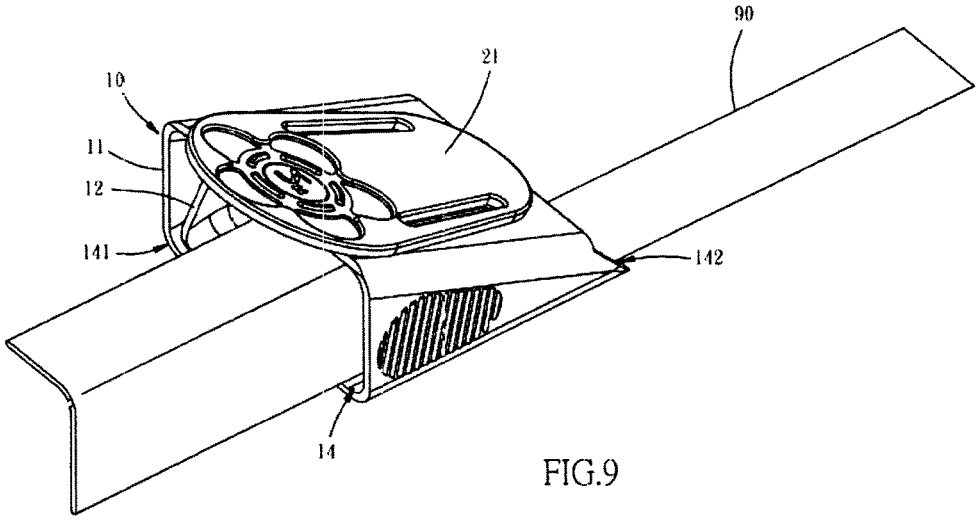
FIG. 9 is another perspective view showing the operation of the fabric folding machine according to the preferred embodiment of the present invention.
Figure 10:
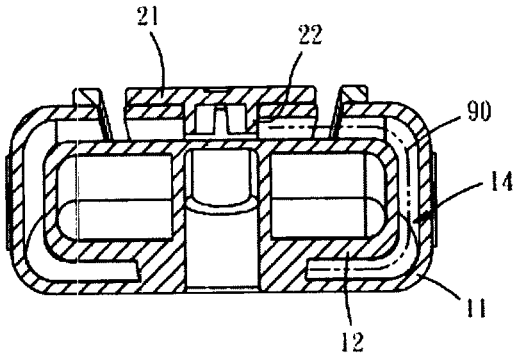
FIG. 10 is another cross sectional view showing the operation of the fabric folding machine according to the preferred embodiment of the present invention.
Figure 11:
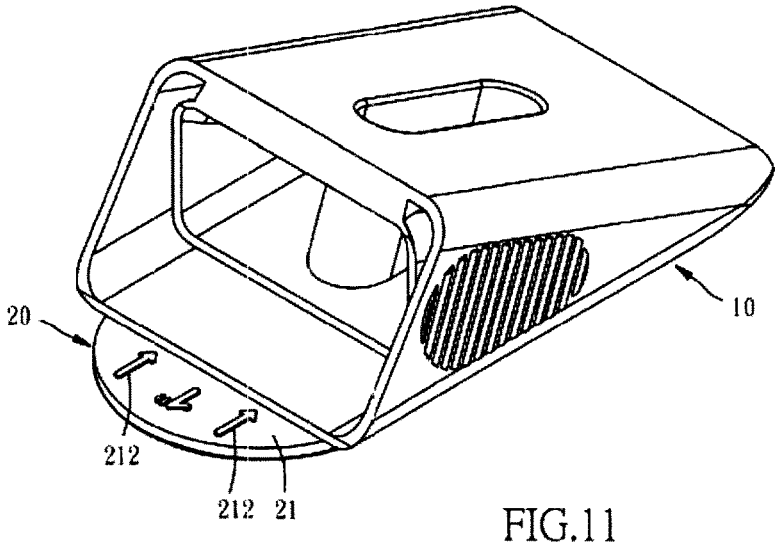
FIG. 11 is a perspective view showing the assembly of a fabric folding machine according to another preferred embodiment of the present invention.

Thereafter, the protrusion 22 of the limiter 20 is inserted into the second orifice 116 of the body 10, and the fabric strip 90 is inserted toward the second segment 142 of the through hole 14 from the first segment 141 of the through hole 14 again, as shown in FIGS. 9 and 10, and the protrusion 22 stops the fabric strip 90 between the second peripheral fence 115 and the through hole 14, such that after the fabric strip 90 extends out of the second segment 142, its two peripheral sides are folded in half again by using the through hole 14, as illustrated in FIG. 9, thus folding the fabric strip 90 repeatedly.

When the protrusion 22 of the limiter 20 is arranged in the second orifice 116 of the body 10, the two openings 211 of the limiter 20 are in communication with the two guiding apertures 117 of the body 10, as shown in FIG. 9. After inserting an elongated object (not shown) through the two openings 211 and the two guiding apertures 117 and aligning the elongated object with the through orifice 14, the fabric strip 90 is moved smoothly in the fabric folding machine 100 by the elongated object.

Furthermore, the limiter 20 is operated by user's left hand or right hand alternatively. Preferably, the sheet 21 has two arrow symbols 212 marked thereon so as to indicate operating direction.

With reference to FIGS. 1 to 3, when the sheet 21 is located on a first face of the protrusion 22, it has a first indication symbol 1" denoted by a reference number 213 so as to fold the fabric strip 90 in one inch, and when the sheet 21 is located on a second face of the protrusion 22 opposite to the first face of the protrusion 22, it has a second indication symbol 2" represented by a reference number 214 so as to fold the fabric strip 90 in two inches.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A fabric folding machine comprising:

a body integrally formed and including an external housing, an internal housing, and a connection portion; the external housing having a first peripheral fence, a second peripheral fence opposite to the first peripheral fence, and two third peripheral fences connected with the first peripheral fence and the second peripheral fence, wherein the internal housing is disposed in the external housing, and between the external housing and the internal housing is defined a through hole, the through hole has a first segment and a second segment, and a height of the first segment is more than that of the second segment; the connection portion is in connection with the first peripheral fence of the external housing and the internal housing and its width gradually decreases from the first segment to the second segment, wherein the first peripheral fence has a first orifice defined thereon, the second peripheral fence has a second orifice communicating with the through hole, and the second peripheral fence also has two guiding apertures communicating with the through hole;

a limiter including a sheet and a protrusion extending outwardly from the sheet so as to alternatively accommodate in the first orifice or the second orifice of the body, wherein the sheet has two openings defined thereon.

2. The fabric folding machine as claimed in claim 1, wherein the third peripheral fence has an anti-slip portion arranged on an outer surface thereof.

3. The fabric folding machine as claimed in claim 2, wherein the anti-slip portion is a rough face.

4. The fabric folding machine as claimed in claim 1, wherein when the protrusion of the limiter is arranged in the second orifice of the body, the two openings of the limiter are in communication with the two guiding apertures of the body.

5. The fabric folding machine as claimed in claim 1, wherein the sheet has two arrow symbols marked thereon so as to indicate operating direction.

6. The fabric folding machine as claimed in claim 1, wherein when the sheet is located on a first face of the protrusion, it has a first indication symbol; and when the sheet is located on a second face of the protrusion opposite to the first face of the protrusion, it has a second indication symbol.

7. The fabric folding machine as claimed in claim 6, wherein the first indication symbol is one inch, and the second indication symbol is two inches.

8. The fabric folding machine as claimed in claim 7, wherein the second indication symbol is twice more than the first indication symbol.

* * * * *